United States Patent [19]

Meade

[11] Patent Number: 4,531,667

[45] Date of Patent: Jul. 30, 1985

[54] EXPANDABLE ENVELOPE FILE

[75] Inventor: Donn W. Meade, Chicopee, Mass.

[73] Assignee: Dennison National Company, Holyoke, Mass.

[21] Appl. No.: 520,904

[22] Filed: Aug. 8, 1983

[51] Int. Cl.[3] ..... B65D 27/08

[52] U.S. Cl. ..... 229/1.5 R; 229/72

[58] Field of Search ..... 229/1.5 R, 72, DIG. 3; 40/359

[56] References Cited

U.S. PATENT DOCUMENTS

| | | | |
|---|---|---|---|
| 1,742,993 | 1/1930 | Jettinger | 40/359 |
| 2,037,579 | 4/1936 | Jonas | 40/359 |
| 3,323,708 | 6/1967 | Nesbit | 229/72 |
| 4,192,447 | 3/1980 | Ambrosat | 229/72 |
| 4,221,161 | 9/1980 | Hurt | 229/72 |
| 4,262,838 | 4/1981 | Mackenzie | 229/DIG. 3 |
| 4,313,558 | 2/1982 | Benham | 229/72 |
| 4,331,290 | 5/1982 | Benham | 229/72 |
| 4,401,257 | 8/1983 | Benham | 229/72 |

FOREIGN PATENT DOCUMENTS

| | | | |
|---|---|---|---|
| 78626 | 7/1962 | France | 229/72 |

*Primary Examiner*—Stephen P. Garbe

*Attorney, Agent, or Firm*—Chapin, Neal & Dempsey

[57] ABSTRACT

An expandable, multi-pocket envelope is disclosed which is formed by die-cutting, scoring and folding a unitary blank. The blank is formed from a resiliently flexible sheet material and includes a front, back and two intermediate panels. The panels are all foldable in superposed relation about spaced, parallel crease lines. The outer edge of one intermediate panel is cut to include an index tab. A slot is provided between the opposed adjacent edges of the front panel and the other intermediate panel and each of these opposed edges is cut to include an index tab. Inwardly foldable glue bearing panels are provided along the side edge portions of said blank and a closure flap is disposed on the outer end edge of the back panel.

1 Claim, 3 Drawing Figures

Fig. 2.
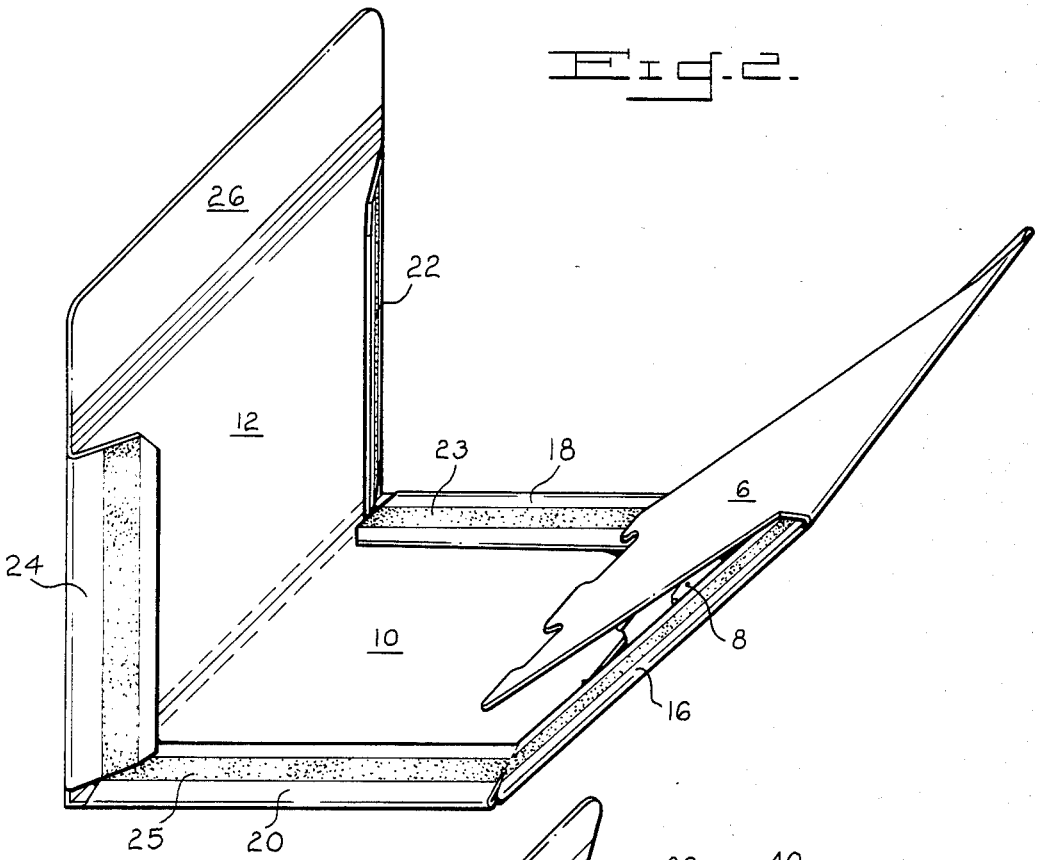
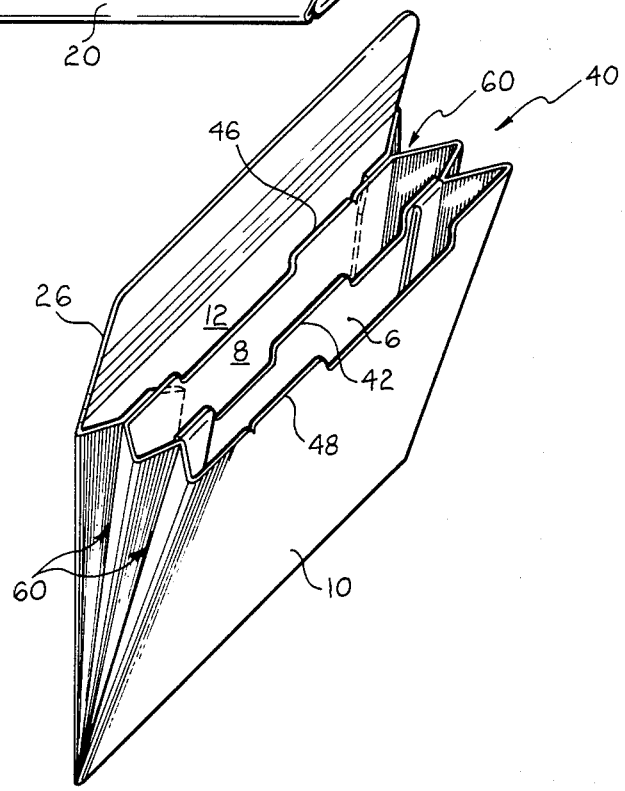
Fig. 3.

EXPANDABLE ENVELOPE FILE

BACKGROUND OF THE INVENTION

This invention relates to expandable multi-pocket file folders or envelope of the type disclosed in U.S. Pat. No. 4,313,558. While the expandable envelope disclosed in the '558 patent is formed from a unitary blank it includes a plurality of panels, two of which are foldable along common side edge crease lines and two foldable along a common end-edge. In addition, a plurality of rectangular areas on both the back and front surfaces of the blank are coated with glue and these areas are arranged along six different locations across the width of the blank. Thus, while this patent discloses a multiple pocket expandable envelope, the blank from which it is formed is relatively complex.

It is the principal object of this invention to provide an improved expandable multi-pocket envelope.

It is another object of this invention to provide an improved method of fabricating an expandable multi-pocket envelope formed from an integral blank of simple configuration.

It is a further object of this invention to provide an expandable envelope of the above type in which a unitary blank is die-cut and scored to a simple, articulated, in-line combination of foldable panels.

Yet another object of this invention is to provide an envelope of the above type in which the blank per se is die-cut to include index tabs along edges of said panels adapted to be oriented upwardly in the envelope.

It is also an object of this invention to provide a plurality of glue receiving flaps along each of the side edges of the foldable blank for simple in-line glue application on the same surface thereof.

The above and other objects and advantages of this invention will be more readily apparent from the following description read in conjunction with the following drawings in which:

FIG. 2 is a perspective view of the blank of FIG. 1 in partially folded condition as in forming an envelope of the type embodying this invention, and FIG. 3 is a perspective view of a multi-pocket expandable envelope of the type embodying this invention.

Figure 1:
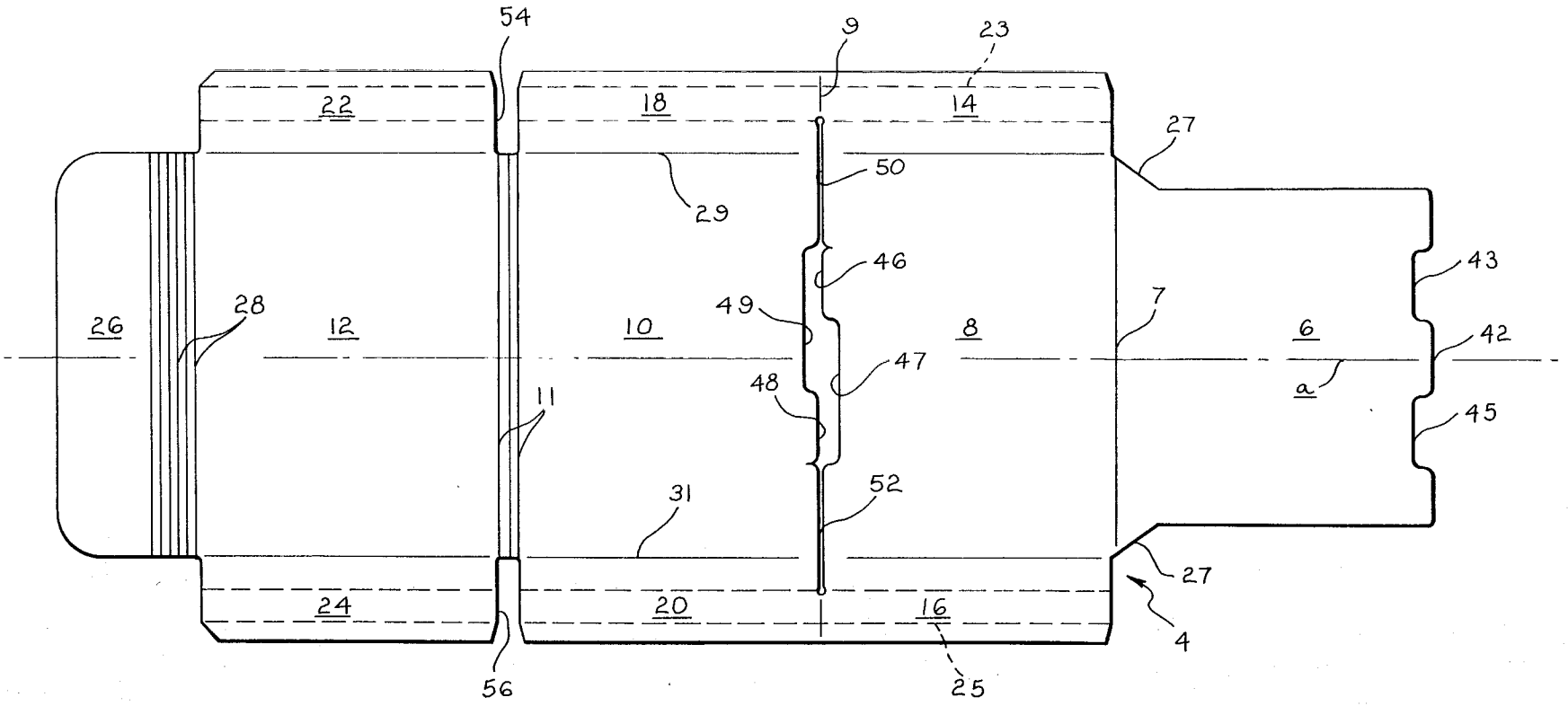
FIG. 1 is a plan view showing a blank of the type used to fabricate expandable envelopes which embody this invention.

As best illustrated in FIG. 1, the blank 4 is a die-cut and scored or creased sheet material comprising a plurality of panels 6, 8, 10, and 12 foldable in superposed relation along a plurality of laterally extending parallel and longitudinally spaced fold lines represented as lines 7, 9 and 11 as illustrated, panels 12 and 6 are the first and second outer end panels respectively and panels 8 and 10 are the first and second inner panels. There are three spaced fold lines 11 which form the bottom of the envelope and allow for its expansion. In addition, the blank 4 includes small flaps 14, 18 and 22 and flaps 16, 20 and 24 disposed along opposite side edges of panels 8, 10 and 12 respectively. As will be hereinafter described, these small edge flaps are coated with a suitable adhesive material in the form of bands or strips 23 and 25 (FIG. 2) for bonding the panels of the blank in the form of an envelope, as shown in FIG. 3. The blank further includes a top closure flap 26 which extends outwardly of the outer end of panel 12. A plurality of parallel, closely spaced fold lines 28 separate the flap from panel 12 and enable this flap to be swung closed along any one of the hinge lines 28 to accommodate envelope contents of varying width. Gussets or triangular webs 27 extend from the lower side edges of panel 6 and intersect panel 8 at crease lines 29 and 31.

Except for cutout portions in the adjacent edges of panels 8 and 10, the blank 4 is symmetrical along its center line or longitudinal axis a and all the main panels are pivotable or foldable about hinge lines which are parallel to each other and, thus, perpendicular to the axis a. The glue panels 14–24 are foldable about hinge or score lines 29 and 30 which are parallel to the axis a of the blank 4. The adhesive strips 23 and 25 are disposed along the outer surfaces of flaps 14, 18 and 22 on one side of the blank and on flaps 16, 20 and 24 on the other side of the blank.

The first outer end panel 12 of the blank provides the back cover of the folder 40 (FIG. 3), flap 26 provides the cover or top closure for the envelope. Panel 10 serves as the front cover of the envelope and the second outer end panel 6 forms the first intermediate or front partition of the expandable envelope and panel 8 forms the second intermediate panel or partition.

As illustrated in FIG. 3, the front wall and the two intermediate or inner panels are each provided with index tabs 48, 42 and 46 respectively. These tabs which are die-cut in the blank 4 are integral with the upper edges of the panels from which they extend, as shown in FIG. 1. The tabs may be approximately marked using a stick-on label or pen to identify the contents to be carried in each of the separate pockets of the envelope.

As shown in FIG. 1, when the blank 4 is die-cut the outer edge of front panel 6 is cut to include U-shaped recesses or cutouts 43 and 45, which define, therebetween, an upstanding index tab 42, which is also shown in FIG. 3. The other index tabs are provided by cutting the blank 4 to include laterally offset cutouts or recesses 47 and 49 which provide for tab 46 which extends from panel 8 and tab 48 which extends in the opposite direction from panel 10. Narrow slits 50 and 52 extend from the outer ends of cutouts 49 and 48 respectively. The slits terminate at hinge line 9 between the glue flaps 14 and 18 on one hand and 16 and 20 on the other. A pair of U-shaped outwardly opening U-shaped slots 54 and 56 are located between the flaps 18 and 22 on one side of the blank 4 and 20 and 24 on the other side.

To assemble the expandable envelope, as shown in FIG. 2, it is only necessary after activating the glue strips 23 and 25 to fold the glue flaps inwardly over the outer side edge portions of panels 8, 10 and 12. Thereupon, end panel 6 is folded over adjacent first inner panel 8, and these two panels are in turn folded upon the front or second inner panel 10. Finally, the three superposed panels are folded upon the rear panel 12. The side edge portions of the superimposed panels are firmly pressed together to ensure a good adhesive bond and the envelope is completed. It will be recognized that the simple in-line and symmetrical nature of the blank 4 provides for a very easy sequential folding operation. Starting with the outer end panel 6, the folding proceeds in one direction about the several parallel fold lines which define the major panels of the folder.

Since the glue strips 23 and 25 are disposed inwardly a substantial distance from the side edge fold lines 29 and 31, the envelope file has accordion-type pleats, as shown on 60 in FIG. 3. This construction permits the envelope to be generally flat for storage and shipment or to be greatly expanded to accommodate a large number of documents or other items in each of the three separate document receiving pockets.

Having thus disclosed this invention, what is claimed is:

1. A unitary blank for forming an expandable, multipocket envelope, said blank formed by die-cutting and creasing a resiliently flexible sheet material to form said unitary blank having longitudinally spaced, laterally extending parallel crease lines defining a plurality of generally rectangular panels joined together in end-to-end relation by said crease lines and forming a generally rectangular blank of articulated panels, said blank including side edge flaps inwardly foldable along longitudinally extending hinge lines which are adapted to receive adhesive dispersed along one surface thereof, said blank including first and second outer end panels and first and second inner panels, the latter including adjacent edges spaced apart to define a laterally extending cutout and having at least one integral, laterally spaced index tab along each of said adjacent edges, the first outer end panel serving as a back cover for the envelope and the second outer end panel being adapted to be folded within said envelope to provide an inner partition therefor, the outer edge of said second outer end panel having an outer edge which includes at least one integal index tab which is laterally offset from each of the index tabs which extend from the adjacent edges of the inner panels, the panels of said envelope being dimensioned so that when the blank is folded sequentially from the second outer end panel until all said panels are superimposed one upon the other, all said tabs are disposed along the upper edge of the envelope in laterally offset relation.

* * * * *